US009332343B2

(12) United States Patent
Hogan et al.

(10) Patent No.: US 9,332,343 B2
(45) **Date of Patent: *May 3, 2016**

(54) MULTI-CHANNEL AUDIO SYSTEM HAVING A SHARED CURRENT SENSE ELEMENT FOR ESTIMATING INDIVIDUAL SPEAKER IMPEDANCES USING TEST SIGNALS

(71) Applicant: Apple Inc., Cupertino, CA (US)

(72) Inventors: Roderick B. Hogan, San Francisco, CA (US); Nathan A. Johanningsmeier, San Jose, CA (US)

(73) Assignee: Apple Inc., Cupertino, CA (US)

( * ) Notice: Subject to any disclaimer, the term of this patent is extended or adjusted under 35 U.S.C. 154(b) by 113 days.

This patent is subject to a terminal disclaimer.

(21) Appl. No.: 14/252,472

(22) Filed: Apr. 14, 2014

(65) Prior Publication Data

US 2015/0296293 A1 Oct. 15, 2015

(51) Int. Cl.
*H04R 29/00* (2006.01)
*H04R 3/00* (2006.01)

(52) U.S. Cl.
CPC . *H04R 3/00* (2013.01); *H04R 29/00* (2013.01)

(58) Field of Classification Search
CPC .... H04R 29/00; H04R 29/001; H04R 29/002; H04R 3/12
See application file for complete search history.

(56) References Cited

U.S. PATENT DOCUMENTS 4,953,218 A * 8/1990 Hughes, Jr. ..... H04R 27/00 381/55
5,592,394 A * 1/1997 Wiscombe ..... H02J 1/10 307/31
5,625,698 A * 4/1997 Barbetta ..... H04R 3/002 381/59
7,259,618 B2 8/2007 Hand et al.
7,560,983 B1 7/2009 Luschas et al.
7,792,310 B2 * 9/2010 Lee ..... H04S 7/308 381/59
8,325,931 B2 12/2012 Howard et al.
8,422,692 B1 4/2013 Dygert et al.
2002/0153901 A1 * 10/2002 Davis ..... G01R 1/06788 324/600
2005/0175195 A1 * 8/2005 Cheney, Jr. ..... G01R 31/041 381/120
2007/0098190 A1 * 5/2007 Song ..... H03F 1/02 381/120
2011/0116643 A1 * 5/2011 Tiscareno ..... H04R 1/1016 381/58
2012/0154037 A1 6/2012 Pfaffinger et al.
2013/0044888 A1 * 2/2013 Nystrom ..... H04R 29/001 381/59
2013/0251165 A1 * 9/2013 Jorgensen ..... H04R 29/001 381/59
2014/0003616 A1 1/2014 Johnson
2014/0348336 A1 * 11/2014 Tong ..... H04R 29/001 381/59

FOREIGN PATENT DOCUMENTS

EP 2229006 A1 9/2010
EP 2229006 B1 11/2013

* cited by examiner

*Primary Examiner* — Simon Sing
(74) *Attorney, Agent, or Firm* — Blakely, Sokoloff, Taylor & Zafman LLP

(57) ABSTRACT

A programmed data processor obtains a number of input voltage measurements for a number of speaker drivers, respectively, and a sensed shared current being a measure of current in a single power supply rail that is feeding power to each of a number of audio amplifiers while the audio amplifiers are driving the speaker drivers in accordance with a number of audio channel test signals, respectively. The programmed data processor computes an estimate of electrical input impedance of each of the speaker drivers using the input voltage measurement for the speaker driver and using the sensed shared current. Other embodiments are also described and claimed.

23 Claims, 5 Drawing Sheets

MULTI-CHANNEL AUDIO SYSTEM HAVING A SHARED CURRENT SENSE ELEMENT FOR ESTIMATING INDIVIDUAL SPEAKER IMPEDANCES USING TEST SIGNALS

An embodiment of the invention is related to speaker impedance estimation techniques. Other embodiments are also described.

BACKGROUND

Knowledge of the electrical input impedance of an individual speaker driver can be used to for example predict the operating temperature of the speaker so as to better manage long term reliability of an audio system of which the speaker is an important part. A typical technique for computing speaker driver input impedance senses the input voltage and senses the input current (using a current sense resistor), and then computes their ratio to obtain the impedance.

SUMMARY

In portable electronic audio systems that have multiple speakers and multiple amplifiers, which are examples of multichannel audio systems, protecting the battery from temporary but excessive current demands, and meeting a finite power budget in view of the battery's limitations, generally requires controlling the total current that is drawn by the audio subsystem. As a result, there is often a need for a current sense element that can sense the shared or total current used by the audio subsystem.

An embodiment of the invention is a shared current sensing and speaker impedance estimation infrastructure in a multichannel audio system that uses certain types of test signals to help estimate the individual speaker impedances. A shared current sensing element in the audio system is used to estimate (or compute, using digital signal processing techniques) the electrical input impedance of each speaker, without having to sense the individual speaker current or amplifier output current. This approach may help save significant manufacturing costs, as well as printed circuit board area and power consumption, by essentially removing the individual speaker driver current sensing infrastructure (from each audio channel). By eliminating the individual current sensing requirement (where the amplifier output current or the speaker driver input current would have been sensed), a wider range of audio amplifiers may be considered for the audio subsystem design.

In one embodiment of the invention, the speaker driver input voltage is a known variable, either via direct voltage sensing of the amplifier output node or the speaker driver input node voltage, or by estimating the amplifier output voltage or speaker driver input voltage, in view of the source audio channel test signal and an amplifier model (assuming linearity and the absence of amplifier clipping events). The shared current sense element indicates the total power supply current that feeds two or more amplifiers that are sharing the same power supply rail. Test signals are applied to the amplifier inputs, while the above measurements and calculations are made, in order to compute for example the dc (or, alternatively, very low frequency) electrical input impedance of each of the speaker drivers, without having to sense individual input currents of the speaker drivers.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness, a given figure may be used to illustrate the features of more than one embodiment of the invention, or more than one species of the invention, and not all elements in the figure may be required for a given embodiment or species.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
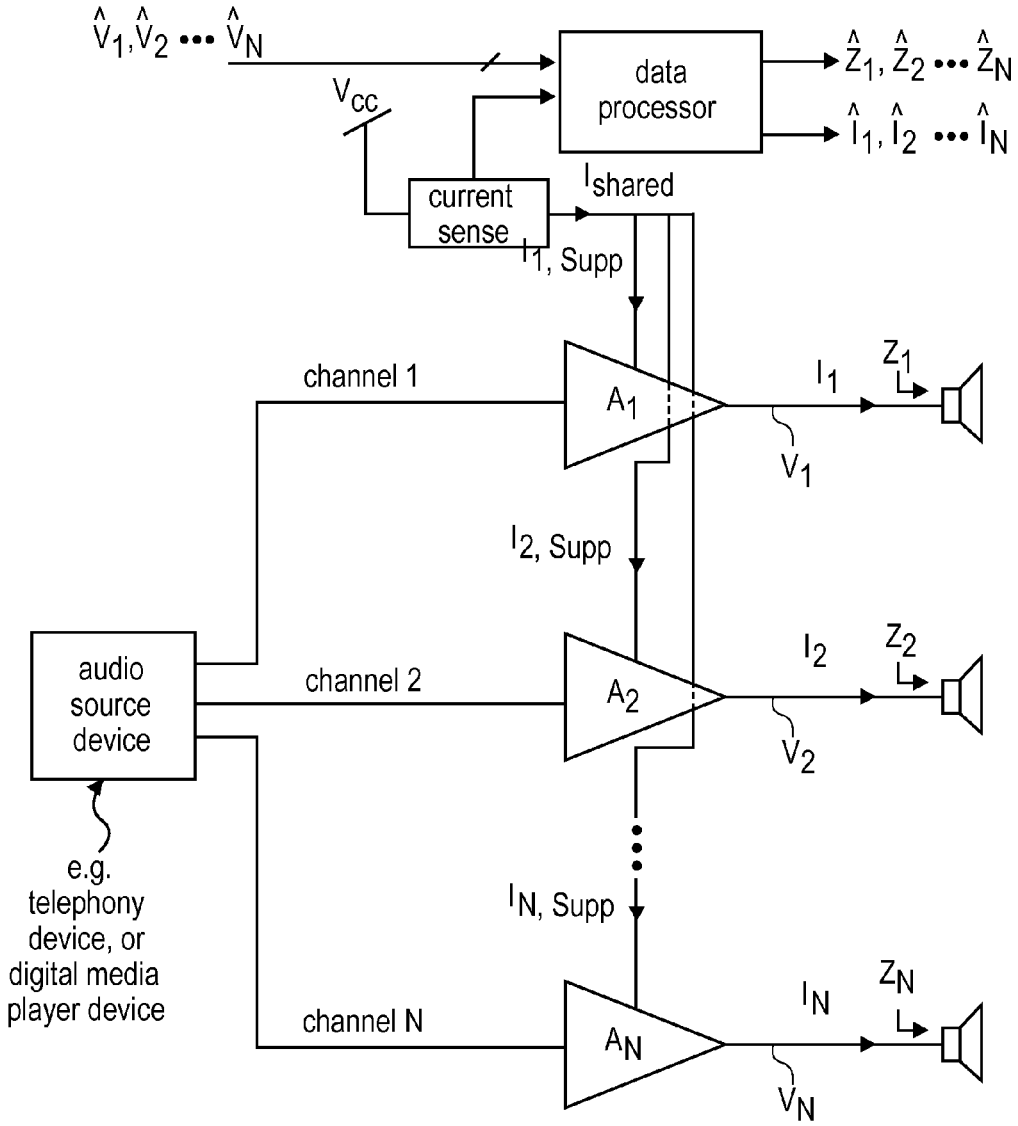
FIG. 1 is a combined block diagram and circuit schematic of a multichannel audio system.
Figure 2:
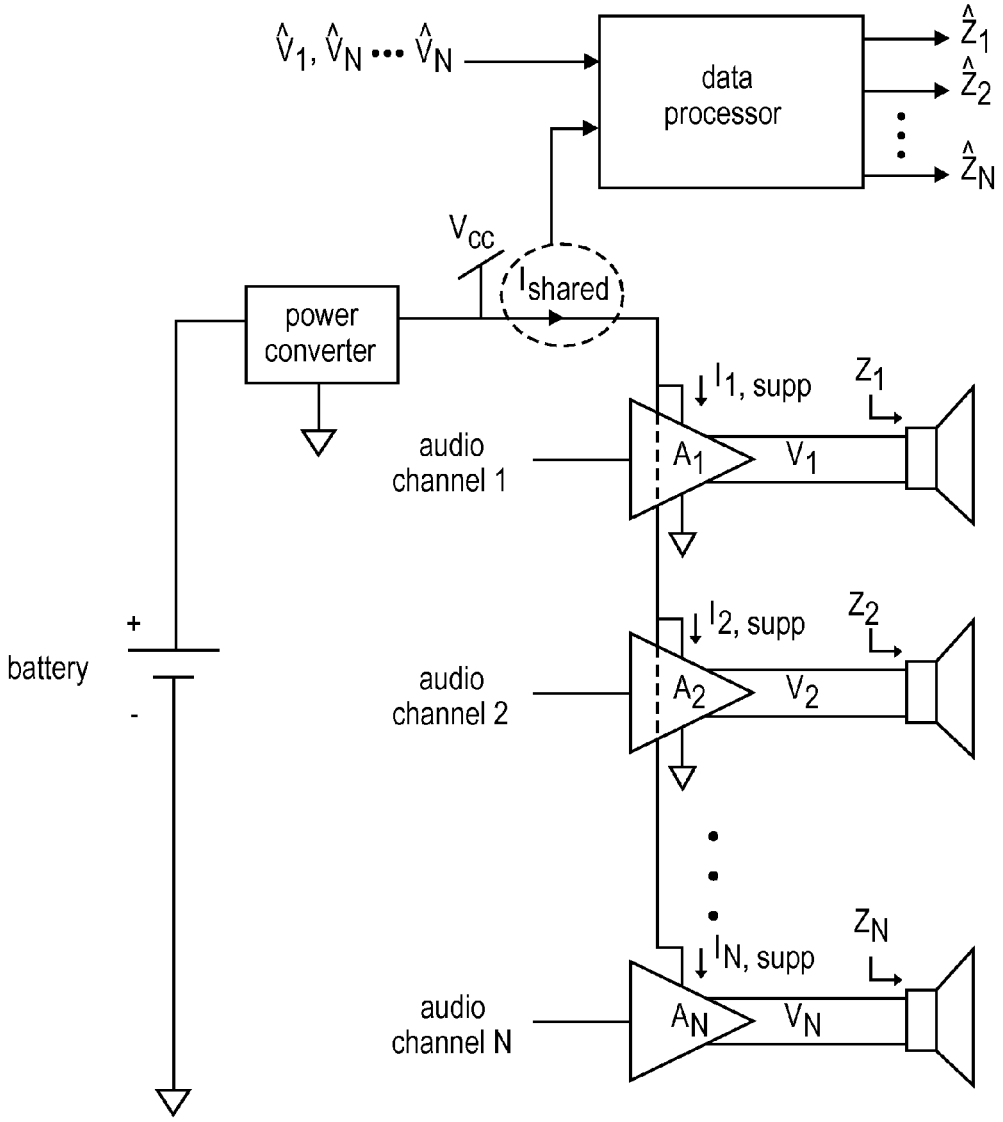
FIG. 2 is a block diagram and circuit schematic of an audio system having Class D amplifiers with differential output.
Figure 3:
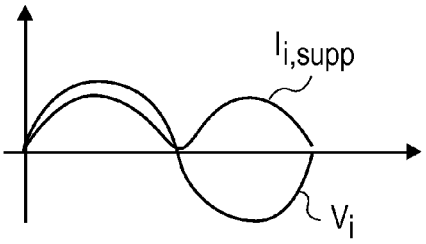
FIG. 3 depicts example waveforms for the shared current and individual speaker driver input voltage versus time, for an audio system having a Class D amplifier.

FIG. 1 is a combined block diagram and circuit schematic of a multichannel audio system. This figure will be used to illustrate an audio signal processing system as described further below, as well as a method for operating an audio system having multiple speaker drivers. The system has a number of speaker drivers where each is illustrated as having an electrical input impedance $Z_1, Z_2, \ldots Z_N$, where N is equal to or greater than 2. As an example, the speakers may be conventional electro dynamic speakers or other types of speakers that are suitable for use in consumer electronic devices such as desktop computers, laptop computers, tablet computers, and smartphones, for example. Each speaker driver is coupled to a respective one of several audio amplifiers $A_1, A_2, \ldots A_N$. The output stage of each amplifier may be single ended or it may be differential. The amplifiers may be of various types including linear amplifiers or Class D amplifiers. Other suitable amplifier topologies for amplifying an audio signal and driving a speaker driver are possible. FIG. 2 for example is an embodiment of the audio system in which the audio amplifiers may be differential output Class D amplifiers. A power supply rail Vcc in this case is fed by a power converter, e.g. a dc-dc voltage boost regulator, and the latter is powered by a battery. FIG. 3 shows how the amplifier supply current $I_{i,supp}$ varies versus time and is, in this case, a somewhat rectified version of the output current (or speaker driver input current). A half-bridge version of such an amplifier exhibits a squaring effect such that the supply current $I_{i,\ supp}$ becomes roughly proportional to the square of the amplifier output voltage $V_i$. A Class D amplifier with a half-bridge arrangement is particularly efficient and therefore suitable for use in battery powered portable electronic devices, although the concepts here are also applicable to other types of audio amplifiers.

Referring to either FIG. 1 or FIG. 2, each of the audio amplifiers is powered from a power supply rail $V_{cc}$. A shared current $I_{shared}$ appears in the power supply rail that may be viewed as a sum of all power supply currents drawn by the amplifiers. Each of the amplifiers may be viewed as drawing its separate supply current $I_{1,\ supp}, I_{2,\ supp}, \ldots I_{N,\ supp}$. A current sense element is shown as being coupled to the power supply rail that produces a sensed shared current which is a measure of $I_{shared}$ in the power supply rail. For improved accuracy, the current sense element should use a current sense resistor, and have suitable voltage sensing and conditioning circuitry in addition to an analog-to-digital converter (not shown) so as to produce the sensed shared current in the form of a discrete time sequence being, for example, a sampled version of $I_{shared}$. However, other techniques for sensing the shared current are possible including the use of a current mirror or perhaps a Hall Effect sensor. It should also be noted that while FIG. 1 depicts the current sense element being positioned on the high side of the power supply arrangement, that is between $V_{cc}$ and the high side power supply input of each amplifier, an alternative may be to position the current sense element on the low side, that is between a power supply return or ground connection of each amplifier (not shown) and a circuit ground.

Each of the audio amplifiers is coupled to receive a respective audio channel signal. These may be from an audio source device such as a telephony device or a digital media player device. The N audio channel signals may have been up-mixed from a fewer number of original channels, or they may be a down mix of a greater number of original channels. The audio source device that produces the N audio channel signals may be integrated with the rest of the audio system, for example, as part of a laptop computer. In many instances, the speakers shown in the figures here may be built-in speakers, that is built into the housing of the consumer electronics device, although as an alternative one or more of the speakers may be external or detachable. In yet another embodiment, the audio source device may be in a different housing than the amplifiers and speakers, such that the N audio channel signals are delivered to the amplifier through a wired or wireless audio communication link.

Regardless of the particular implementation, the relevant audio system or audio subsystem may have a data processor (e.g., a programmed microprocessor, digital signal processor or microcontroller) that obtains a measure of input voltage, $Vhat_1$, $Vhat_2$ . . . $Vhat_N$ for each of the drivers. The data processor computes an estimate of electrical input impedance of each of the speaker drivers, $Zhat_1$, $Zhat_2$ . . . $Zhat_N$, using the sensed shared current (provided by the current sense element) and the measure of input voltage $Vhat_1$, $Vhat_2$ . . . $Vhat_N$ that is associated with that particular driver, while the amplifiers are being driven by test signals (not shown in FIG. 1) rather than user audio content as depicted in FIG. 1. The speaker driver input voltages $V_1$, $V_2$ . . . $V_N$ may be sensed while their corresponding amplifiers $A_1, A_2 \ldots A_N$ are driving the speaker drivers in accordance with their source audio channel test signals. Note here that the speaker driver input voltage may be deemed equivalent to a measure of the corresponding amplifier output voltage, provided that parasitic impedance of the driver signal path between the amplifier output and the speaker driver input is either negligible or can otherwise be accounted through circuit modeling techniques (performed by the programmed data processor). In other words, any reference here to a speaker driver input voltage is understood to also encompass amplifier output voltage.

As part of an audio signal processing system, the programmed data processor (see FIG. 1 for example) receives a number of input voltage measurements for a number of speaker drivers, where each of the voltage measurements can be sensed, time-domain samples (instantaneous voltage) of a respective speaker driver input voltage. As suggested above, an A/D conversion circuit that performs voltage sensing would be needed in that case, whose input is coupled to an input of each of the speaker drivers, wherein the data processor obtains the measure of input voltage for each speaker driver by, for example, computing a frequency domain version of a sensed discrete time sequence produced by the A/D conversion circuitry, for each of the speaker driver input voltages $V_1$, $V_2$ . . . $V_N$. As an alternative, however, the voltage measurements $Vhat_1$, $Vhat_2$ . . . $Vhat_N$ can actually be estimated (computed) time-domain samples of a mathematically derived speaker driver input voltage expression. As another alternative, each of the input voltage measurements can be estimated (computed) directly as a respective spectrum (or frequency domain content), based on the input audio channel signal that is fed to the respective amplifier; this approach may not require sensing the speaker driver input voltage, and instead uses a mathematical relationship that may be readily derived that estimates or predicts the output voltage of each audio amplifier, based on the audio channel signal that is input to that amplifier and a circuit simulation model or characterization of the amplifier. In such a case, there would be no need for a voltage-sensing infrastructure at the inputs of the speaker drivers.

Once the input voltage measurements $Vhat_1$, $Vhat_2$ . . . $Vhat_N$ have been obtained, together with the sensed shared current, the programmed data processor can compute the estimates of electrical input impedance $Zhat_1$, $Zhat_2$ . . . $Zhat_N$, where these estimates may represent linear time invariant impedance that varies as a function of frequency. These may computed in real-time, while the audio amplifiers are driving their respective speaker drivers in accordance with their respective audio channel test signals. A real-time measure of the individual speaker input impedances can be calculated without requiring a current sense infrastructure at the individual speaker level.

Figure 4:
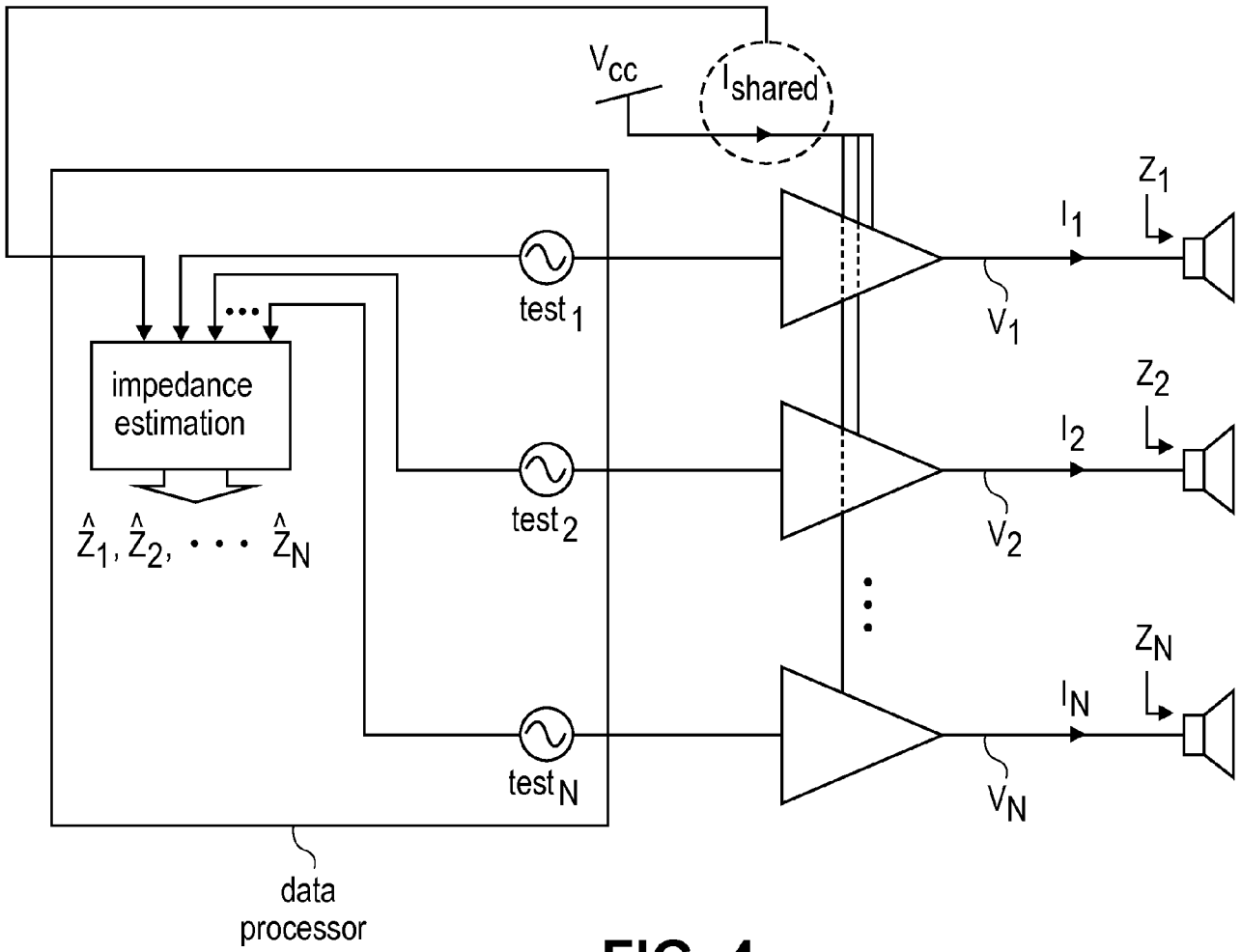
FIG. 4 is a circuit schematic of a multi-channel audio system having a shared current sensing infrastructure that uses test signals to estimate the individual speaker impedances.

Referring now to FIG. 4, a combined block diagram and circuit schematic of a multi-channel audio system is shown that is using N test signals test1, test2, . . . testN (one for each channel), for estimating the individual speaker driver input impedances Z1, Z2, . . . ZN. Each of the test signals may be produced by the data processor (see also FIG. 1) and is applied to the input of its respective amplifier, which in turn is driving the respective speaker driver. While FIG. 4 does not show the shared current sense element separately, and the optional speaker driver input voltage sensing circuitry as described above, these are understood to be present as needed to provide the impedance estimation block of the data processor the known values for Ishared and $Vhat_1$, $Vhat_2$, . . . $Vhat_N$, so that the data processor can compute the impedance estimates $Zhat_1$, $Zhat_2$, . . . $Zhat_N$, using the sensed shared current and the obtained measures of input voltage of the speaker drivers.

The equation to be solved for estimating the impedance of each speaker driver has the following general form $$Ishared_i = Ti * Vi / Zi$$

$$T_i = \frac{I_{i,supp}}{I_i}$$

where $Ishared_i$ is the contribution to the total supply current by amplifier $A_i$, $V_i$ is the speaker driver input voltage for that amplifier, and $Z_i$, the sole unknown, is the speaker driver input impedance. $T_i$ is a predetermined mathematical expression that relates the output current of the amplifier $A_i$ to its power supply input current $I_{i,\ supp}$. A mathematical expression for $T_i$ can be readily derived using circuit modeling and network analysis techniques that in effect characterize the audio amplifier $A_i$, so as to relate the audio amplifier output current (or speaker driver input current that is associated with each amplifier) to the amplifier's input supply current $I_{i,\ supp}$. This model may also include temperature dependence where the model changes depending upon the operating temperature of the amplifier.

Figure 5:
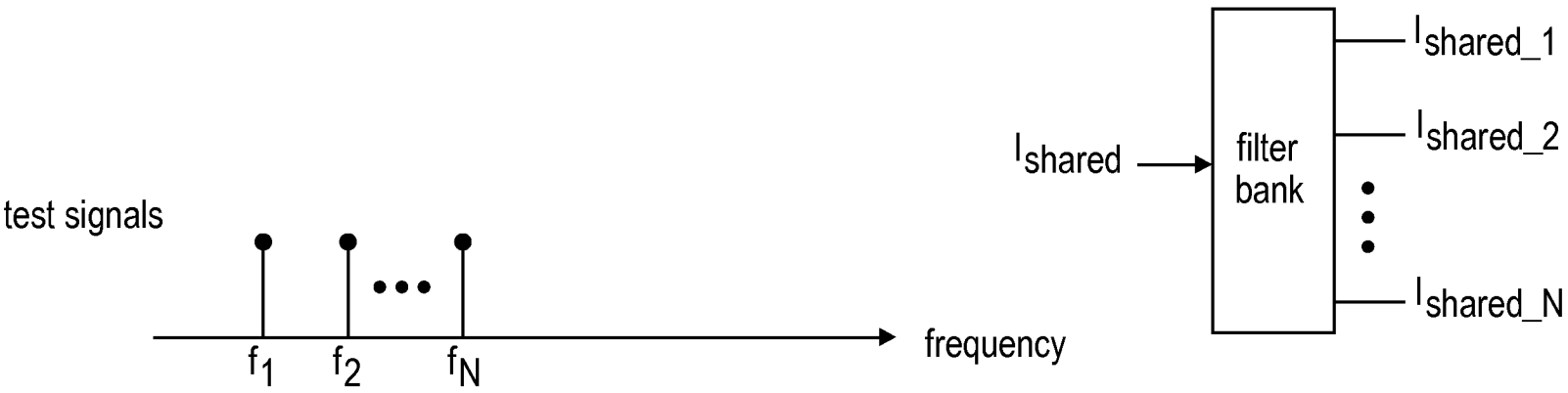
FIG. 5 shows one embodiment of the test signals and the shared current sense infrastructure.

In one embodiment, each of the audio channel test signals is a test tone that is centered at a different frequency. If desired to be inaudible, the frequency (spectral) content of each test signal may be designed to be below the human audible range. The resulting sensed shared current will contain a number of peaks each of which roughly aligns (in frequency) with a respective one of the test tones, due to the power supply current draw of the respective amplifier. This embodiment is illustrated in FIG. 5, which shows a combined spectral diagram for the N test tones; it can be seen that each test tone is centered at a different frequency (frequencies f1, f2, . . . fN). Each test tone may be a non-overlapping, narrow-band or band-limited signal that is centered at a different frequency, e.g. a single-frequency component having a known or fixed magnitude at a known center frequency. Note that the test tones need not be spaced equally as shown and instead could even be positioned randomly. A filter bank (or other suitable band pass-type filter mechanism) filters the sensed shared current (while the test tones were being applied to their respective amplifiers A1, A2, . . . $A_N$), to extract the distinct peaks as N output signals $Ishared_1$, $Ishared_2$ . . . where each is a measure of the contribution to the total supply current from its respective amplifier $A_i$. Each of the output signals may be deemed to be a measure of a peak in Ishared that is aligned with the frequency of a respective tone that is input to a respective amplifier. The filter bank or other suitable digital filter may be implemented by suitably programming the data processor. The data processor then computes the estimate of the electrical input impedance of each of the speaker drivers using a) the measure of a respective one of the peaks, and b) the measure of input voltage for the associated speaker driver. For example, to compute the estimate of Z1, the following equation (having just one unknown) can be solved in the frequency domain, for Z1

$$\text{Ishared_1 (produced by the filter bank)} = T1 * V1 / Z1$$

where T1 is an expression that relates the output current of amplifier A1 to its input supply current (as explained earlier). Note that as a result of the effectively "orthogonal" nature of the test signals, each amplifier is fed its own or "unique" test signal and so there is no need to solve any simultaneous equations. Also, in many cases the speaker driver impedance estimate is of interest in just one or perhaps no more than a few adjacent frequency bins. As a result, the mathematics task of the data processor can be simplified greatly by using for example the Goertzel algorithm to obtain the frequency domain versions of $I_{shared_i}$ and $V_1(t)$, $V_2(t)$, . . . , rather than a Discrete Fourier Tranform (DFT). More generally, the impedance estimation process performed by the programmed data processor here may have the following operations: filtering the sensed shared current to produce a number of filtered output signals each being aligned with a respective one of the different frequencies; and computing the estimate of the electrical input impedance of each of the speaker drivers using one of the filtered output signals and the measure of input voltage of the speaker driver that is associated with said one of the filtered output signals.

Figure 6:
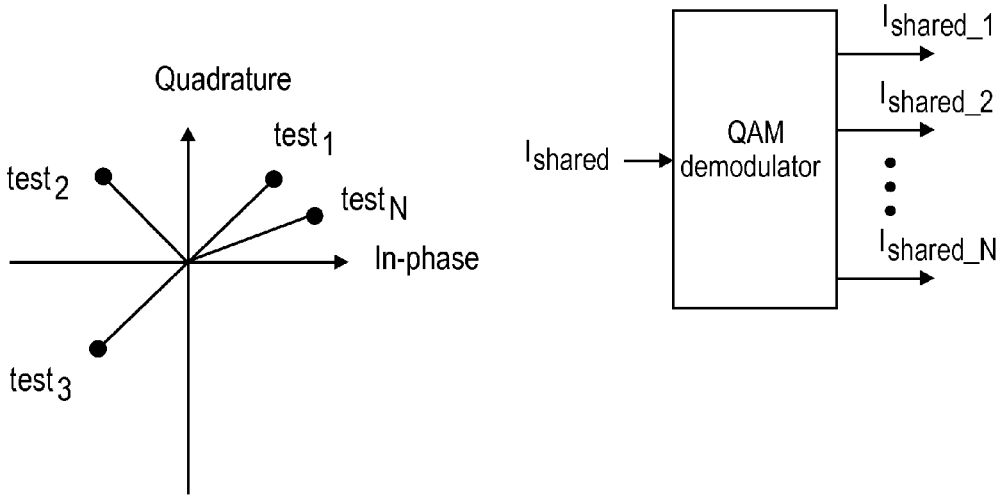
FIG. 6 shows another embodiment of the test signals and shared current sense infrastructure.

In another embodiment, each of the audio channel test signals is a unique phase-modulated or phase-encoded test signal. As a result, the sensed shared current will contain a modulation signature, for each modulated test signal, that is due to the power supply current draw of the respective amplifier. This embodiment is illustrated using the example constellation diagram in FIG. 6, which shows Quadrature Amplitude Modulation (QAM) as an example of phase modulation that may be applied to each test signal. Each test tone may be a non-overlapping phase-modulated signal that has different phase modulation. Note that the test tones need not be spaced equally as shown and instead could even be oriented randomly in the constellation diagram. A QAM demodulator (or other phase demodulator or decoder that is complementary to the modulation used to produce the test signals) processes the sensed shared current (while the test tones were being applied to their respective amplifiers A1, A2, . . . AN), to produce N output signals where each is a measure of the contribution from each amplifier. The demodulator may be implemented by suitably programming the data processor of FIG. 4. The data processor then computes the estimate of the electrical input impedance of each of the speaker drivers using a) the measure of a respective one of the decoded components, and b) the measure of input voltage for the associated speaker driver. For example, to compute the estimate of Z2, the following equation (having just one unknown) can be solved for Z2

$$\text{Ishared_2 (produced by the demodulator)} = T2 * V2 / Z2$$

where T2 is an expression that relates the output current of amplifier A2 to its input supply current (as explained earlier). Note that as a result of the effectively "orthogonal" nature of the test signals, each amplifier is fed its own or "unique" phase-encoded test signal and so there is no need to solve any simultaneous equations. The test signals may be generated by the programmed data processor using any suitable phase modulation technique. More generally, the impedance estimation process performed by the programmed data processor here may have the following operations: where each of the audio channel test signals is a unique phase modulated test signal, the sensed shared current is phase demodulated into a number of demodulated output signals; and the estimate of the impedance of each of the speaker drivers is computed using one of the demodulated output signals and the measure of input voltage of the speaker driver that is associated with said one of the demodulated output signals.

Figure 7:
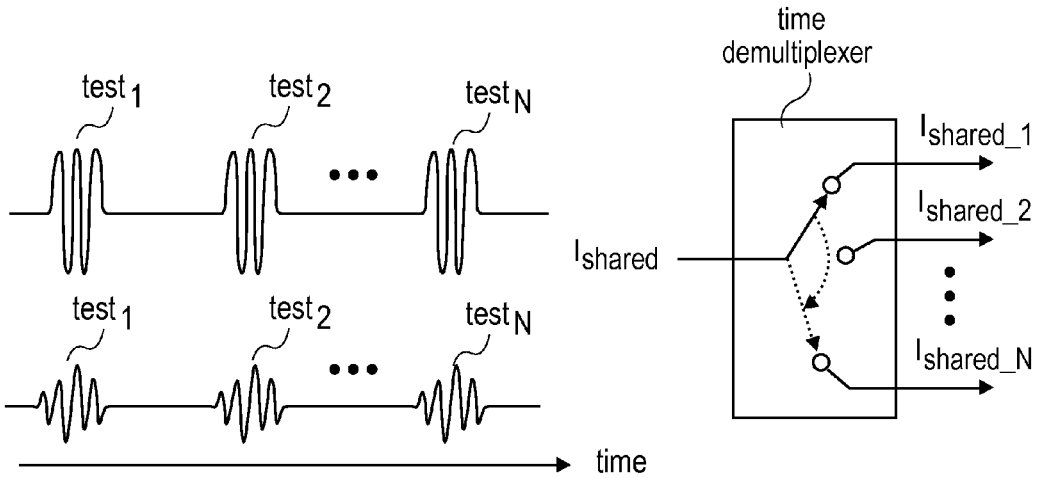
FIG. 7 shows yet another embodiment of the test signals and shared current sense infrastructure.

In yet another embodiment, the N audio channel test signals contain test content that are in effect time division multiplexed. In other words, when the N test signals are supplied to their respective amplifiers, the amplifiers are driven with test content one at a time. For convenience, the test content may be the same in each signal only shifted in time so that none of them overlaps with another—these are depicted by two examples in FIG. 7, including one where the test content consists of several cycles of a pure sinusoid and another with shaped sinusoids. This is contrast to the above-described embodiment of FIG. 5 in which the test content (which may be the same in each signal) is shifted in frequency. Here, the sensed shared current will contain a number of peaks each of which roughly aligns, in time rather than frequency, with the test content in a respective one of the test signals, due to the power supply current draw of the respective amplifier. Note that the test content across all of the test signals need not be spaced equally as shown, and also need not have the same time interval or burst length, and instead could even be sized and positioned randomly. As shown in FIG. 7, a time demultiplexer (which may be implemented by suitably programming the data processor of FIG. 4) extracts each of the respective test content from the sensed shared current (while the test signals were being applied to their respective amplifiers A1, A2, . . . AN), to produce N output signals where each is a measure of the contribution from each amplifier. Each of the output signals may be deemed to be a measure of a portion of Ishared that is aligned in time with a respective test signal that is input to a respective amplifier. The data processor then computes the estimate of the electrical input impedance of each of the speaker drivers using a) the measure of a respective one of the output signals from the demultiplexer, and b) the measure of input voltage for all of the associated speaker driver. For example, to compute the estimate of Z3, the following equation (having just one unknown) can be solved for Z3

$$\text{Ishared_3 (produced by the demultiplexer)} = T3 * V_3 / Z_3$$

where T3 is an expression that relates the output current of amplifier A3 to its input supply current (as explained earlier), and Ishared_3 and $V_3$ are given by their frequency domain versions. Note that as a result of the effectively "orthogonal" nature of the test signals, each amplifier is fed its own or "unique" test signal and so there is no need to solve any simultaneous equations. More generally, the impedance estimation process performed by the programmed data processor here may have the following operations: where each of the audio channel test signals has test content that is shifted in time (or time-multiplexed) so that none of the test content in the test signals overlaps in time with another test content, the sensed shared current is first demultiplexed (in accordance with the known timing with which the test signals were produced) into a number of for example burst-like output signals; the estimate of the impedance of each of the speaker driver is computed using one of the output signals and the measure of input voltage of the speaker driver that is associated with said one of the pulse output signals. It should be noted here that while the time-division multiplexing technique may be used in place of the frequency-shifting and phase-encoding techniques described earlier, an alternative is to combine it with either the frequency-shifting or phase-encoding techniques so that the test content in either of those cases is applied one at a time (sequentially or randomly) to the amplifiers, which may make it easier to extract the test content from the sensed shared current.

As explained above, an embodiment of the invention may be a machine-readable medium (such as microelectronic memory) having stored thereon instructions, which program one or more data processing components (generically referred to here as a "processor") to perform the digital audio processing operations described above including arithmetic operations, filtering, mixing, inversion, comparisons, and decision making. In other embodiments, some of these operations might be performed by specific hardware components that contain hardwired logic (e.g., dedicated digital filter blocks). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the description above refers to techniques for estimating individual speaker impedances, this should be understood as also encompassing the alternative but equivalent mathematical construct of computing individual speaker admittances, where admittance is the inverse of impedance and is typically defined as Y=1/Z. The description is thus to be regarded as illustrative instead of limiting.

What is claimed is:

1. A method for operating an audio system having a plurality of speaker drivers, comprising:

providing a plurality of audio channel test signals simultaneously to inputs of a plurality of audio amplifiers, respectively, while each of the audio amplifiers is driving its respective speaker driver;

sensing current of a single power supply rail that is feeding power to each of the plurality of audio amplifiers, while each of the amplifiers is driving its respective speaker driver, to produce a sensed shared current;

obtaining a measure of input voltage of each of the speaker drivers; and computing an estimate of electrical input impedance of each of the speaker drivers, using the sensed shared current and the measure of input voltage of said speaker driver.

2. The method of claim 1 wherein obtaining a measure of input voltage of each of the speaker drivers comprises:

sensing instantaneous voltage of an input of each of the speaker drivers, using voltage sensing and A/D conversion circuitry.

3. The method of claim 1 wherein obtaining a measure of input voltage of each of the speaker drivers comprises:

computing an estimate of the input voltage of each of the speaker drivers, based on a respective one of the audio channel test signals and a model of a respective one of the audio amplifiers.

4. The method of claim 1 wherein each of the plurality of audio channel test signals is a test tone that is centered at a different frequency, of a plurality of different frequencies.

5. The method of claim 4 further comprising:

filtering the sensed shared current to produce a plurality of filtered output signals each being aligned with a respective one of said different frequencies, and wherein computing the estimate of the electrical input impedance of each of the speaker drivers uses one of the filtered output signals and the measure of input voltage of the speaker driver that is associated with said one of the filtered output signals.

6. The method of claim 1 wherein each of the plurality of audio channel test signals is a unique phase modulated test signal, the method further comprising phase demodulating the sensed shared current into a plurality of demodulated output signals.

7. The method of claim 6 wherein computing the estimate of the impedance of each of the speaker drivers uses one of the demodulated output signals and the measure of input voltage of the speaker driver that is associated with said one of the demodulated output signals.

8. The method of claim 1 wherein each of the plurality of audio channel test signals has test content that is shifted in time so that none of the test contents, in all of the plurality of test signals, overlaps in time with another test content.

9. The method of claim 8 further comprising time demultiplexing the sensed shared current into a plurality of pulse output signals.

10. The method of claim 9 wherein computing the estimate of the impedance of each of the speaker drivers uses one of the plurality of output signals and the measure of input voltage of the speaker driver that is associated with said one of the output signals.

11. An audio system comprising:

a data processor;

a power supply rail;

a current sense element coupled to the power supply rail to produce a sensed shared current being a measure of current in the power supply rail;

a plurality of audio amplifiers each being coupled to be powered by the power supply rail and to receive a respective audio channel test signal; and a plurality of speaker drivers each being coupled to a respective one of the amplifiers; and wherein the data processor obtains a measure of input voltage for each of the speaker drivers, and computes an estimate of electrical input impedance of each of the speaker drivers using the measure of input voltage of the speaker driver and using the sensed shared current.

12. The system of claim 11 wherein each of the plurality of audio channel test signals is a test tone that is centered at a different frequency of a plurality of different frequencies.

13. The system of claim 12 wherein the data processor filters the sensed shared current to produce a plurality of filtered output signals each being aligned with a respective one of said different frequencies, and wherein the estimate of the electrical input impedance of each of the speaker drivers is computed using one of the filtered output signals and the measure of input voltage of the speaker driver that is associated with said one of the filtered output signals.

14. The system of claim 11 wherein each of the plurality of audio channel test signals is a unique phase modulated test signal, wherein the data processor phase demodulates the sensed shared current into a plurality of demodulated output signals, and computes the estimate of the impedance of each of the speaker drivers using one of the demodulated output signals and the measure of input voltage of the speaker driver that is associated with said one of the demodulated output signals.

15. The system of claim 11 wherein each of the plurality of audio channel test signals has test content that is shifted in time so that none of the test contents, in all of the plurality of test signals, overlaps in time with another test content.

16. The system of claim 11 wherein the data processor time demultiplexes the sensed shared current into a plurality of pulse output signals, and computes the estimate of the impedance of each of the speaker drivers using one of the plurality of pulse output signals and the measure of input voltage of the speaker driver that is associated with said one of the pulse output signals.

17. The system of claim 11 wherein the data processor obtains the measure of input voltage for each of the speaker drivers as a frequency domain version, and computes the estimate of input impedance of each of the speaker drivers by solving a respective equation having the frequency domain version of the input voltage and a frequency domain version of the sensed shared current as known terms, and the input impedance as a single unknown term.

18. The system of claim 11 further comprising A/D conversion circuitry coupled to an input of each of the speaker drivers, wherein the data processor obtains the measure of input voltage for each speaker driver by computing a frequency domain version of a discrete time sequence produced by the A/D conversion circuitry.

19. An audio signal processing system comprising:

a programmed data processor that is to obtain a plurality of input voltage measurements for a plurality of speaker drivers, respectively, the programmed data processor to obtain a sensed shared current being a measure of current in a single power supply rail that is feeding power to each of a plurality of audio amplifiers, while the audio amplifiers are driving the speaker drivers in accordance with a plurality of audio channel test signals, respectively, and the programmed data processor to compute an estimate of electrical input impedance of each of the speaker drivers using the input voltage measurement for the speaker driver and using the sensed shared current.

20. The system of claim 19 wherein the processor is to compute a frequency domain version of each of the input voltage measurements, and a frequency domain version of the sensed shared current, and to compute the estimate of input impedance of each of the speaker drivers by solving a respective equation having the frequency domain versions of a respective one of the input voltage measurements and of the sensed shared current as known, and the input impedance as a single unknown.

21. The system of claim 19 wherein each of the plurality of audio channel test signals is a test tone that is centered at a different frequency, wherein the processor is to filter the sensed shared current to produce a plurality of filtered output signals each being aligned with a respective one of said different frequencies, and wherein the estimate of the electrical input impedance of each of the speaker drivers is computed using one of the filtered output signals and the measure of input voltage of the speaker driver that is associated with said one of the filtered output signals.

22. The system of claim 19 wherein each of the plurality of audio channel test signals is a unique phase modulated test signal, the system further comprising:

a phase demodulator to receive the sensed shared current and in response produce a plurality of demodulated output signals, and wherein the processor is to compute the estimate of the impedance of each of the speaker drivers using one of the demodulated output signals and the measure of input voltage of the speaker driver that is associated with said one of the demodulated output signals.

23. The system of claim 19 wherein each of the plurality of audio channel test signals has test content that is shifted in time so that none of the test contents, in all of the plurality of test signals, overlaps in time with another test content, the system further comprising:

a time demultiplexer to receive the sensed shared current and in response produce a plurality of output signals, and wherein the processor is to compute the estimate of the impedance of each of the speaker drivers using one of the plurality of output signals and the measure of input voltage of the speaker driver that is associated with said one of the output signals.

* * * * *